US006425501B1

(12) United States Patent
Keung et al.

(10) Patent No.: US 6,425,501 B1
(45) **Date of Patent: *Jul. 30, 2002**

(54) PUMP DISPENSER HAVING VENT VALVE

(75) Inventors: Wing-Kwong Keung, Perrysburg; Scotty Ferrell, Put-in-Bay; Gennaro R. Martire, Toledo, all of OH (US)

(73) Assignee: Owens-llinois Closure Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/860,511

(22) Filed: May 21, 2001

Related U.S. Application Data

(63) Continuation of application No. 09/466,513, filed on Dec. 17, 1999, now Pat. No. 6,244,473.

(51) Int. Cl.[7] ..... B65D 37/00
(52) U.S. Cl. ..... 222/207; 222/383.1
(58) Field of Search ..... 222/383.1, 207

(56) References Cited

U.S. PATENT DOCUMENTS

| | | | | |
|---|---|---|---|---|
| 3,726,442 A | * | 4/1973 | Davidson et al. | 222/207 |
| 3,768,734 A | * | 10/1973 | Anderson, Jr. et al. | 222/383.1 |
| 3,897,006 A | * | 7/1975 | Tada | 239/333 |
| 3,973,700 A | * | 8/1976 | Schmidt et al. | 222/153 |
| 3,986,644 A | * | 10/1976 | Grogan et al. | 222/207 |
| 4,101,057 A | * | 7/1978 | LoMaglio | 222/207 |
| 4,921,017 A | * | 5/1990 | Tada | 137/843 |
| 5,114,052 A | * | 5/1992 | Tiramani et al. | 222/207 |
| 5,603,434 A | * | 2/1997 | von Schuckmann | 222/383.1 |
| 5,636,768 A | * | 6/1997 | Yamada | 222/207 |
| 5,711,460 A | * | 1/1998 | Saito et al. | 222/380 |
| 5,738,251 A | * | 4/1998 | Schuckmann | 222/383.1 |

* cited by examiner

*Primary Examiner*—William C. Doerrler
*Assistant Examiner*—Stephanie L. Willatt

(57) ABSTRACT

The end of the arm on the pivoted trigger of a pump dispenser brushes against a projection on the wider end of a funnel-shaped seal to distort the wider end, breaking its seal against the inside of a tubular support for the pump dispenser and opening a vent to the atmosphere.

3 Claims, 2 Drawing Sheets

PUMP DISPENSER HAVING VENT VALVE

CROSS REFERENCE TO RELATED APPLICATION

This application is a continuation of application Ser. No. 09/466,513 filed Dec. 17, 1999 now U.S. Pat. No. 6,244,473.

FIELD OF THE INVENTION

This invention relates to pump dispensers. More specifically, this invention relates to pump dispensers in which a trigger works a pump and periodically opens a vent, permitting air from the outside into the container to replace displaced liquid.

BACKGROUND OF THE INVENTION

The von Schuckmann patent U.S. Pat. No. 5,603,434 issued Feb. 18, 1997 discloses a pump dispenser having a trigger-type actuator having a rearward arm which vents the container when the trigger is drawn back. More specifically, the arm brushes a projection on a tubular liner which normally engages about the inside of the tubular support for the pump. The projection raises the line away from the wall of the support to partly uncover a vent opening.

The present invention may be regarded as an improvement on the invention shown in von Schuckmann '484 in that it provides for a funnel-shaped vent seal which assures by its structure a reliable breaking of the seal at positions of the trigger and a reliable closing of the seal when the trigger is released.

SUMMARY OF THE INVENTION

The invention is, of course, described in the claim language below. Briefly, in a pump dispenser the present invention comprises a funnel-shaped vent seal which has a line contact with the inside of the pump body tubular support. The funnel-shaped vent seal includes a forward projection adapted to be engaged by a rearward arm on the trigger to permit air into the dispenser container.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
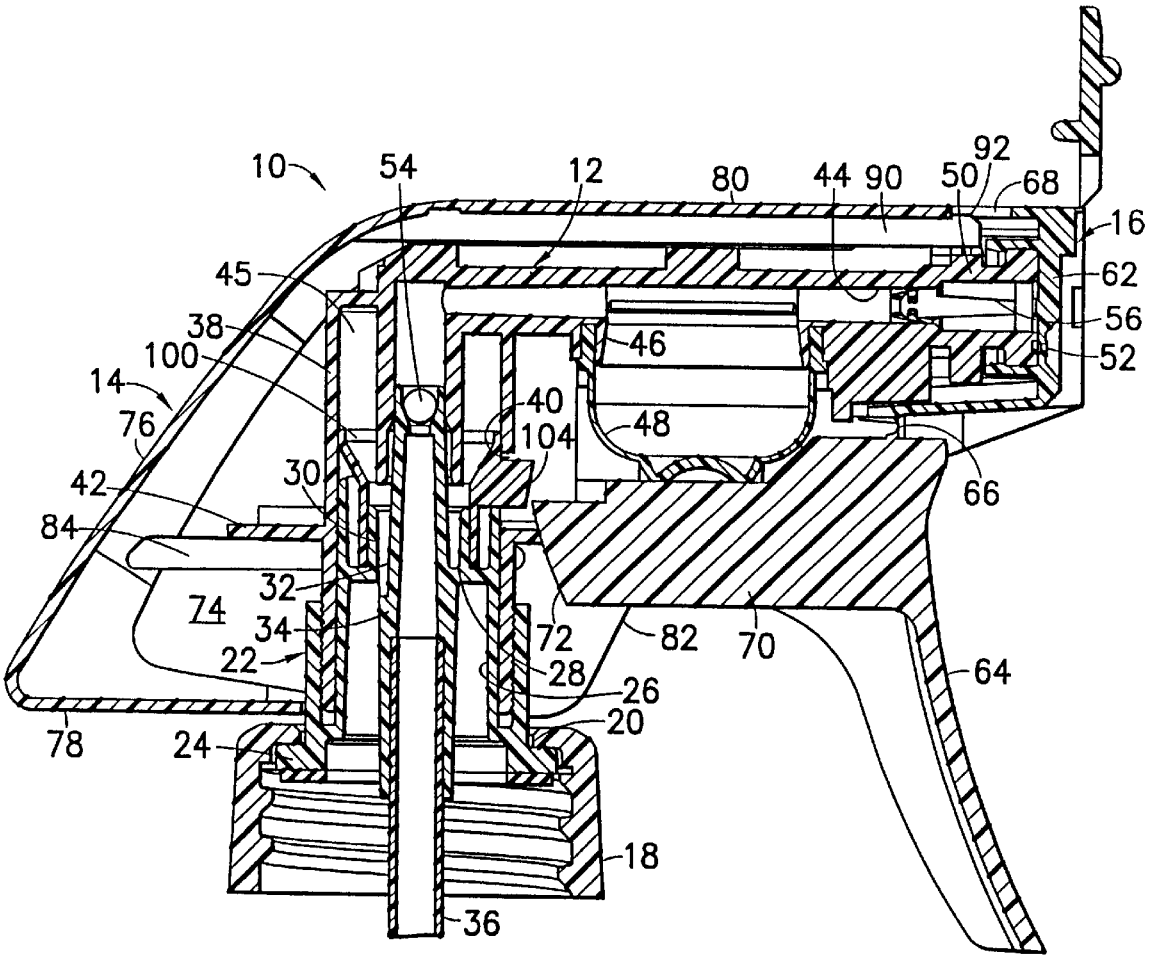
FIG. 1 is a vertical sectional view through a pump dispenser embodying the invention.

A pump dispenser embodying the invention is generally designated 10 in FIG. 1. Its structure is generally similar to that shown in the von Schuckmann patent U.S. Pat. No. 5,603,434. It comprises a pump body 12 and shroud 14 and a nozzle cap/unit 16.

The pump body 12, considered from its lower end, comprises a screw cap 18 adapted to screw onto the finish of a container (not shown) and having an opening 20 rotatably receiving a tubular retainer 22. At its lower end the retainer 22 has an outward annular flange 24 by which it is clamped onto the finish of the container by the screw cap 18. The retainer 22 has an inner annular wall 26 having an integral inner transverse floor 28 and an upward barrel 30. The floor is formed with a passage 32 which extends from inside the inner wall 26 up to inside the barrel 30 as shown. An intake tube 34 having a dip tube 36 attached is disposed axially with respect to the retainer.

A tubular support 38 telescopes over the inner wall 26 of the retainer. It includes an opening 40 facing the front of the dispenser. The tubular support 38 is formed with a rearward shelf 42 and above the shelf a rightward tubular extension 44 connects to tube 34. Above the opening the interior of the tubular support is a closed annular chamber 45.

Extension 44 mounts a downward circular fitting 46. The fitting receives a resilient bellows 48. The rightward tubular extension 44 terminates in a nozzle fitting 50 which receives the nozzle unit cap 16 formed with the outlet orifice 52 equipped with the usual swirl chamber (not shown).

Valve means for the pump are provided. A ball check 54 serves as the inlet valve, working against a seat in the upper end of the retainer. A movable tulip valve 56 as described in U.S. Pat. No. 5,687,877 comprises the discharge valve. It seats in the forward end of the tubular extension 44. The nozzle cap unit 16, molded integrally, comprises the cap 62 and the trigger 64 hingedly connected by a living hinge 66. The cap is formed with an opening 68 in its top wall. The trigger 64 has a rearwardly extending arm 70 which terminates in a bevelled face 72.

Figure 2:
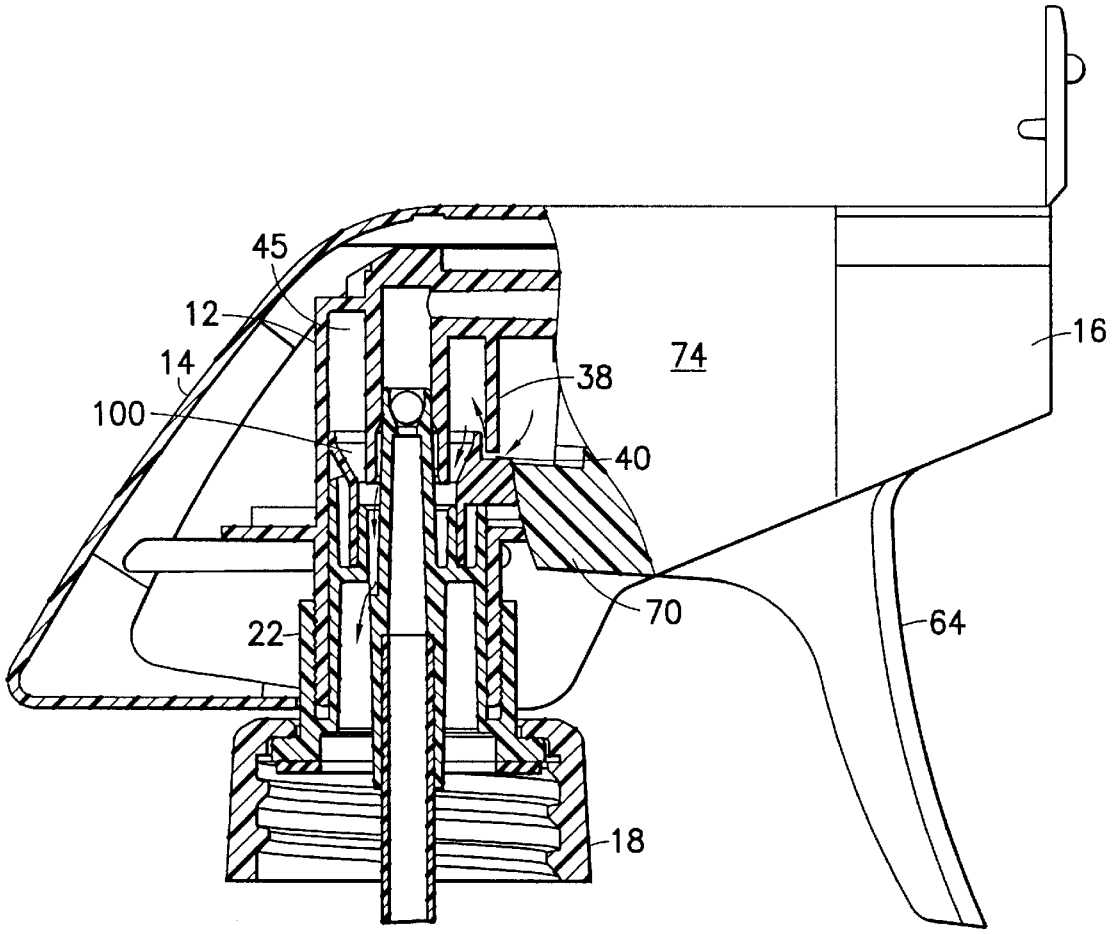
FIG. 2 is a partial vertical sectional view through the dispenser showing the seal cracked open as for venting.

The shroud 14 (FIG. 2) is open-fronted. It comprises side walls 74, a sloping rear end wall 76, a connected bottom wall 78 and a top wall 80. The front 82 is open to receive the pump body 12. A shoulder 84 is integrally formed with other portions of the shroud.

The shroud 14 has on the underside of its top wall 80 a forwardly extending tongue 90. Forward of the shroud front 82 the tongue has an upward hook 92 having a rearwardly facing barb.

In assembly the shroud is moved forward from the rear of the pump body. There are other ways of latching the shroud in place. One is described in U.S. Pat. No. 5,890,632 issued Apr. 6, 1999. With the simplified arrangement depicted here, not part of this invention, the hook slips under the top wall of the cap and snaps up into the opening 68 in the cap. Simultaneously the shelf 42 slides under the shoulder 84 to hold the body and shroud together as a unit.

Figure 4:
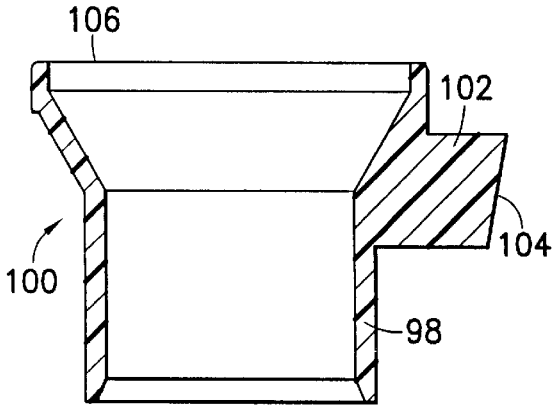
FIG. 4 is a vertical sectional view of the seal.
Figure 3:
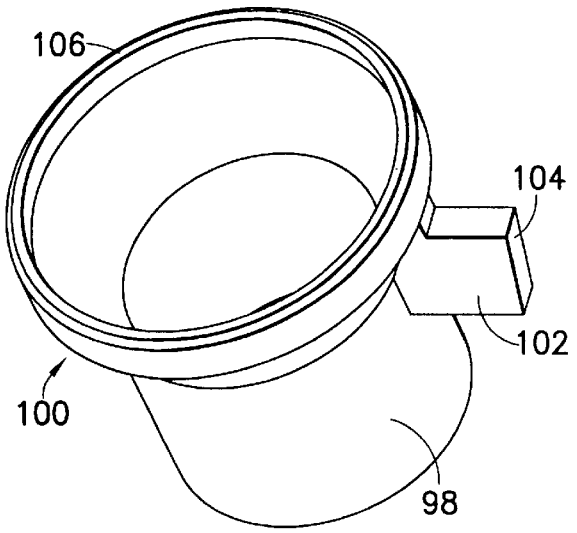
FIG. 3 is an enlarged perspective view of the funnel-shaped seal per se.

Sealingly mounted on the barrel 30 (FIG. 1) is the smaller end 98 of a resilient funnel-shaped vent seal 100 which has a forward projection 102 having bevelled face 104 (FIG. 4). The upper, larger end 106 of the funnel-shaped vent seal valve engages sealingly about the inside of the tubular support 38 in line contact just above the opening 40. The bevelled faces 72 and 104 assist in the seal-breaking action.

As the pumping is achieved by intermittent squeezing of the trigger 64 toward the screw cap, the bevelled face 72 engages the bevelled face 104 of projection 102 to distort the top of the seal and permit venting of atmosphere in through the opening 40 down inside the funnel-shaped seal through the barrel 30 and passage 32 into the head space of the container (not shown). The venting is effected only when the trigger 64 is partly or totally retracted and the face 72 of the trigger arm engages and pushes inward the projection 102.

With the nozzle cap unit 16 in final position, a pumping can be achieved by successive pull backs of the trigger 64 to compress the bellows 48 as described in the von Schuckmann patent. Venting is accomplished simultaneously by the accompanying intermittent distortion of the seal 100 in accordance with this invention.

This invention is not limited to dispensers of the von Schuckmann type, but may be used with piston/cylinder dispenser in which a pivoted trigger is employed.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. In a dispensing pump comprising a pump body having a closed tubular support formed with a vent opening, a tubular resilient vent valve disposed concentrically inside the support engaging the inside of the support adjacent the vent opening to close the vent opening and having a projection extending through the vent opening, and a trigger pivotally mounted on the pump body, the trigger having a rearward arm with an end adapted to engage the vent valve projection from a lateral direction as the trigger pivots, the improvement wherein the tubular resilient vent valve is tapered having a wider end and a reduced end and its wider end makes line contact with the tubular support about the inside thereof above the vent opening, and an axially disposed barrel disposed concentrically inside the tubular support is sealingly connected to the container and the reduced end of the resilient valve.

2. A dispensing pump as claimed in claim 1 wherein the vent valve is funnel shaped.

3. A dispensing pump as claimed in claim 1 wherein the end of at least one of the projection or arm has a bevelled face.

* * * * *